United States Patent [19]

Epel et al.

[11] 4,334,563

[45] Jun. 15, 1982

[54] SWINGABLE IMPACT TOOL

[75] Inventors: Joseph N. Epel, Southfield; Robert E. Wilkinson, Birmingham; Probir K. Guha, Mt. Clemens, all of Mich.; Albert S. Crandon, Jr., Pittsburgh, Pa.

[73] Assignee: The Budd Company, Troy, Mich.

[21] Appl. No.: 170,418

[22] Filed: Jul. 21, 1980

[51] Int. Cl.[3] ..... B26B 23/00

[52] U.S. Cl. ..... 145/2 R; 145/29 R; 145/29 B

[58] Field of Search ..... 145/29 R, 29 B, 2 R

[56] References Cited

U.S. PATENT DOCUMENTS

| | | | |
|---|---|---|---|
| 2,738,815 | 3/1956 | Hoeldtke | 145/2 R |
| 2,837,381 | 6/1958 | Sarlandt | 145/29 R |
| 3,115,912 | 12/1963 | Harris | 145/29 R |
| 3,175,232 | 3/1965 | Stowell | 145/29 R |
| 3,578,825 | 5/1971 | Merrow | 145/29 R |
| 3,844,321 | 10/1974 | Cook | 145/29 R |
| 3,874,433 | 4/1975 | Shepherd et al. | 145/29 R |
| 4,039,012 | 8/1977 | Cook | 145/29 R |
| 4,165,771 | 8/1979 | Curati | 145/29 R |
| 4,172,483 | 10/1979 | Bereskin | 145/29 B |

FOREIGN PATENT DOCUMENTS

| | | | |
|---|---|---|---|
| 653050 | 11/1962 | Canada | 145/29 R |
| 501140 | 11/1954 | Italy | 145/29 R |
| 2215 | 1/1890 | Sweden | 145/29 R |
| 98736 | 4/1940 | Sweden | 145/29 R |
| 1291845 | 10/1972 | United Kingdom | 145/29 R |

*Primary Examiner*—Nicholas P. Godici
*Assistant Examiner*—J. T. Zatarga
*Attorney, Agent, or Firm*—A. L. Trueax, Jr.

[57] ABSTRACT

A swingable impact tool and a method of making it wherein the tool has a metal head fastened both chemically and mechanically to a handle made of a composite of materials including a pultrusion of fiberglass filaments in a matrix of polymerized thermosetting resin covered by elastomeric urethane form which protects the core member from impact loads and absorbs the transfer of shock loads to the hands of the user. Metal or plastic members are used to reinforce critical areas of the handle adjacent the head and the stem member disposed within the socket in the head.

10 Claims, 10 Drawing Figures

SWINGABLE IMPACT TOOL

This invention relates to hand tools and to the method of making them and more particularly to swingable impact tools such as malls, hammers, sledges, picks, axes, and wood splitters.

Impact tools have ancient origins that usually incorporate a heavy head and a handle of wood. In recent years, efforts have been made to provide handles made of more durable materials such as metals or plastics or a combination thereof but frequently such handles are inferior in at least some respects to those made of wood.

An object of this invention is to provide an impact tool and the method of making it in which the handle has high strength and resistance to impact forces.

Another object of the invention is to provide a swingable impact tool and the method of making it in which the tool has a metal head and a composite handle having impact resistance characteristics superior to wood handles.

Another object of the invention is to provide an improved arrangement for firmly fastening a handle made principally of plastic resin materials to a metallic head of an impact tool.

Yet another object of the invention is to provide an impact tool in which the handle is made principally of plastic material and is held to a metallic striking head by means which reinforce the area of the handle within the head.

These and other objects of the invention are accomplished by a swingable impact tool having a metallic head member with a socket which receives the stem portion of a handle. The handle includes a core member extending the full length of the handle made of fiberglass reinforced resin and having a substantially uniform cross section. The core member is covered with a plastic foam sheath extending from the head and enveloping the core member to protect the structural core member and to offer a resilient handle having the appearance of wood but being sufficiently elastomeric to absorb shock loads. The metallic head is attached to the stem of a handle through means of a wire mesh reinforcement and a polymerized urethane resin which fills the socket in the head and surrounds the stem and wire mesh member. The handle has a thicker cover of foam material in the shank area of the handle adjacent the head than in the remainder of the handle. In the same location the width of the handle and therefore the thickness of the foam cover is slightly less to avoid contact of the handle with the material being struck. The shank portion of the handle adjacent the head is also covered with an elastomeric sleeve which further protects the handle and particularly the shank area which is subject to overstrikes from damage by impact.

The method by which the impact tool is made includes covering a core with foam material under certain temperature conditions to form a foam sheath with a hard outer skin over the structural core and subsequently heating the head and maintaining it under load while the cavity formed in the socket of the head and the stem disposed within the socket is filled with a resin which hardens to hold the head in position on the handle both chemically and mechanically.

These and other objects of the invention will be apparent from the following description and from the drawings in which.

Figure 1:
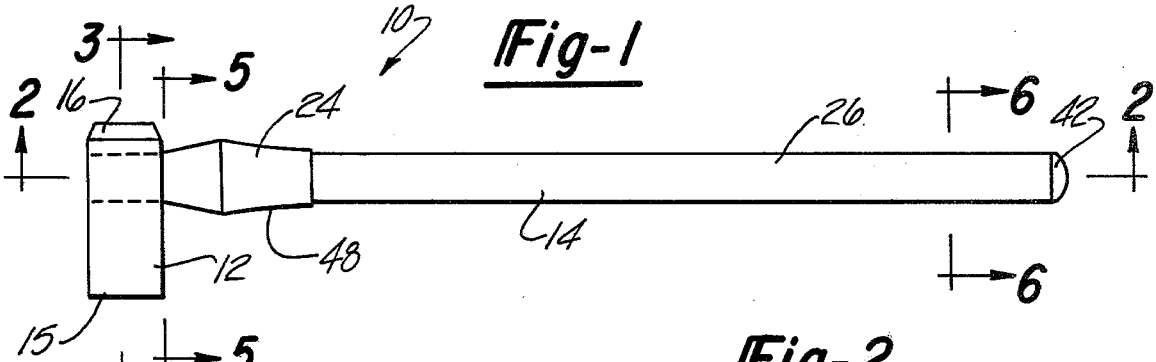
FIG. 1 is a side elevation of a wood splitting, swinging impact tool embodying the invention.

An impact tool embodying one aspect of the invention is designated generally at 10 and includes a head 12 made of metal attached to a handle 14 made of a composite of plastic, glass fibers and metal.

The head 12 can take various forms but the embodiment illustrated in the drawings is for the purpose of splitting wood and is of metal with a wedge shape including a blade edge 15 and an anvil end 16 which can be struck with another impact tool such as a hammer during wood splitting operations. The head 12 typically is made by forging and has a socket or eye 17 for receiving one end of the handle 14. The socket 17 is shaped like an hour-glass with a generally oval or ellipsoidal cross section with oppositely extending tapered surfaces 18.

The handle 14 which is attached to the metal striking head 12 is conventional in that it has a shape similar to wood handles and in that it appears to be made of wood but it is made primarily of plastic materials and includes metal components and fiberglass filaments. For the purpose of the following description, the handle 14 will be considered to include a stem 20 intended to be positioned within the socket or eye 17 formed in the head 12. The handle 14 also is considered to have a shank 24 which is that part of the handle 14 immediately adjacent the head 12 and which sometimes is subject to impact blows when the head 12 overstrikes or misses its target. The handle 14 also is considered to have a grip 26 which is that portion of the handle 14 extending from the shank 24 to the end of the handle opposite the head 12. The grip 26 is held by two hands of the user of the tool at the instant that an impact blow is delivered to an object being worked upon which in the present case would be a length of log being split.

The handle 14 has a core member 30 extending for the entire length of the handle and forms the stem 20 at one end. The core member 30 is a pultrusion having a uniform cross section for its entire length. The cross section is a modified I-beam section of polymerized thermoset resin reinforced with a high density of fiberglass filaments extending for the full length of the core 30. In an actual embodiment of the invention a density of glass fibers of 60 to 70 percent was used in a resin matrix. The core member 30 is relied upon to provide the strength, stiffness and torsional rigidity of the handle 14. The modified I-beam cross section used a minimum amount of material in the area of the neutral axis of the handle 14 which is generally along line 2—2 in FIG. 1 in the area forming the web 31.

A pair of reinforcing members 32 are disposed at opposite sides of the stem 20 and the shank 24 and are bonded in position in cavities formed at opposite sides of the web 33 and between flange portions 34 of the core member 30 as seen in FIGS. 2–5. Preferably, the reinforcing members 32 are made of metal although they could be of other high strength materials including pultrusions made of the same material as the core 30.

That portion of the handle extending from the stem 20 or head 12 and including the shank 24 and the grip 25 is covered by a foam cover portion or sheath 36 made of a microcellular urethane having elastomeric, shock absorbing characteristics. The outer surface of the sheath 36 has a skin 38 of relatively high density foam material with a lower density of the same material extending between the skin 38 and the core member 30. The average density of the foam cover 36 is about 40 pounds per cubic foot, and the outer skin 38 has a density of between 60 to 62 pounds per cubic foot and a durometer of between 30 and 35 D. This gives the handle 16 a pleasant feed to the hands and absorbs some of the shock loads that otherwise are transmitted from the head 12 of the impact tool 10 through the handle 14. The overall cross section of the shank 24 and the grip 26 is generally elliptical or ellipsoidal with the major axis extending in the direction of the web 34 of the core member 30.

The foam cover 36 is substantially uniform for the length of the grip 26 of the handle 14 but is greater in thickness in the direction of the major axis of the elliptical cross section adjacent to the head 14, that is, in the area of the shank portion 24. Also, in the same area, the foam cover or sheath 36 is less in thickness in the direction of the minor axis of the ellipse than in the grip portion 26. This is for the purpose of minimizing contact of wood with the foam cover if the split formed in the wood is less than the handle width or when the handle is pried from side to side in an effort to complete a split or to remove the head 12 from an incomplete split.

The handle 14 is secured to the head 12 with the stem 20 in the socket or eye 17 of the head 12. The stem 20 is provided with a hole 39 which extends through the reinforcing members 32 and the web 31 of the core member 30. The stem 20 also is surrounded with a layer of metallic mesh 40. The stem 20 and mesh 40 are disposed in the socket 17 and are bonded to the head and to each other by a two part adhesive such as urethane or epoxy which occupies all of the remaining space between the walls of the socket 17 and the stem 20. The polymerized urethane forms a chemical bond with the stem 20 and an adhesive bond with the metal head. This is supplemented by the hole 39 which serves the purpose of mechanically locking the handle to the body of polymerized adhesive which in turn is mechanically locked in the socket 17 due to the oppositely extending tapered portions 18. The wire mesh member 40 serves to reinforce the stem 20 to resist breakage and also to mechanically link the polymerized resin portions disposed in the oppositely tapered portions of socket 17. In this manner, the handle 14 is attached to the metal head 12, not only chemically, but also mechanically.

Figure 2:
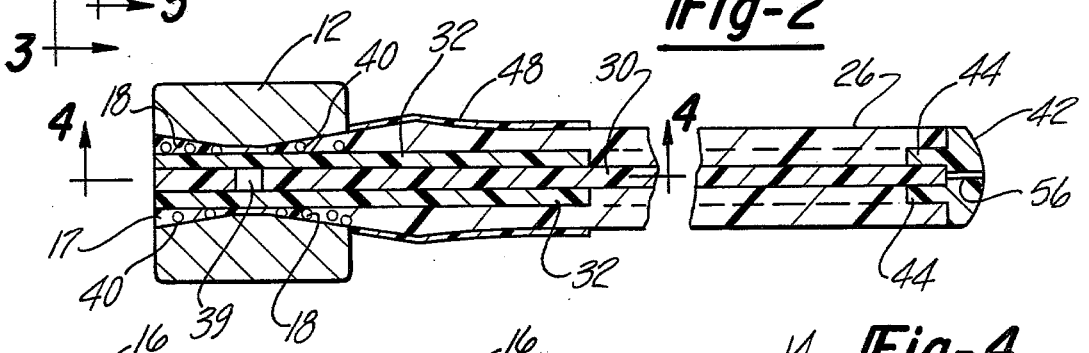
FIG. 2 is a cross sectional view at a slightly enlarged scale taken on line 2—2 in FIG. 1.
Figure 3:
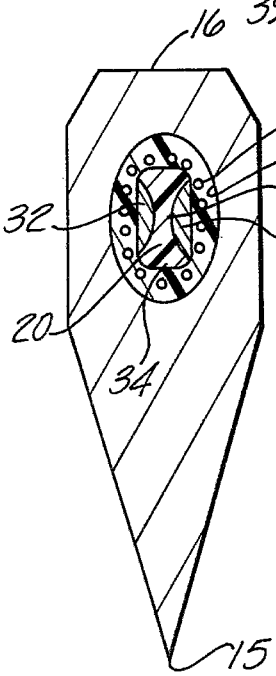
FIG. 3 is a cross section taken on line 3—3 in FIG. 1.
Figure 4:
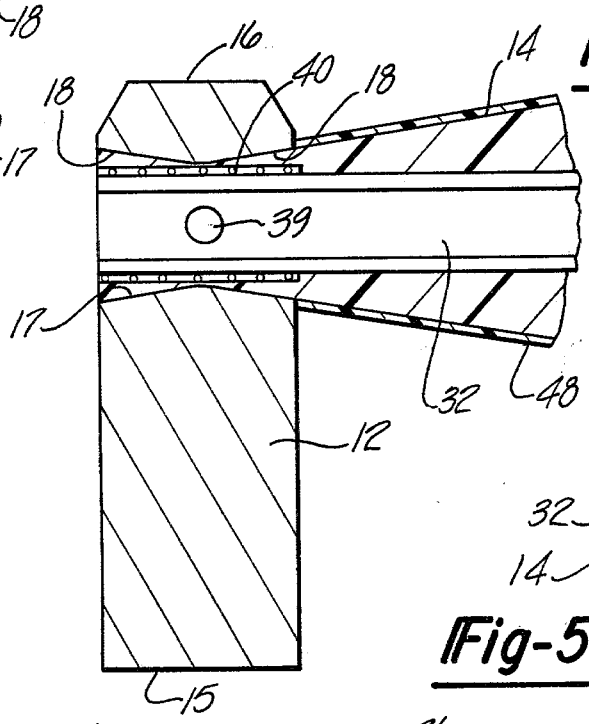
FIG. 4 is a sectional view taken on line 4—4 in FIG. 2.
Figure 5:
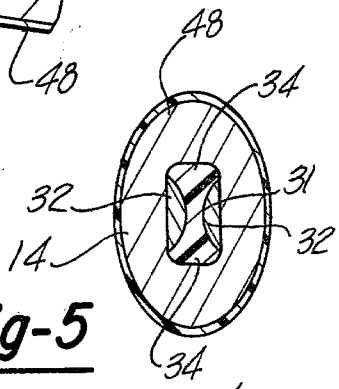
FIG. 5 is a cross sectional view of a portion of the handle taken on line 5—5 in FIG. 1.
Figure 6:
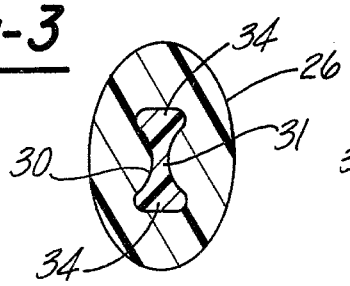
FIG. 6 is a cross sectional view similar to FIG. 5 taken on line 6—6 in FIG. 1.

The end of the handle 14 opposite the head 12 is provided with an end cap molded of an impact resistant plastic material. The end cap 42 has the same oval cross section as the end of the handle 14 and is provided with a pair of tabs 44 which as seen in FIG. 2 fit into the cavities at opposite sides of the web 31 of the core member 30. The cap 42 is bonded into position by the urethane foam forming the cover 36. End cap 42 protects the foam sheath 36 and skin 38 from damage in the event that the tool 10 is dropped on the butt end of handle 14 or if that end is struck on a hard object as is customary for the purpose of tightening the head on handles made of wood.

The shank 24 of the handle 14 is covered with a sleeve 48 of a tough urethane elastomer which is separately injection molded in a shape to conform to the shape of the shank portion 24 of the handle 14. The sleeve 48 is slipped into position after the handle is formed and further protects the core 30 as well as the cover 36 from overstrikes during use of the tool 10.

Figure 10:
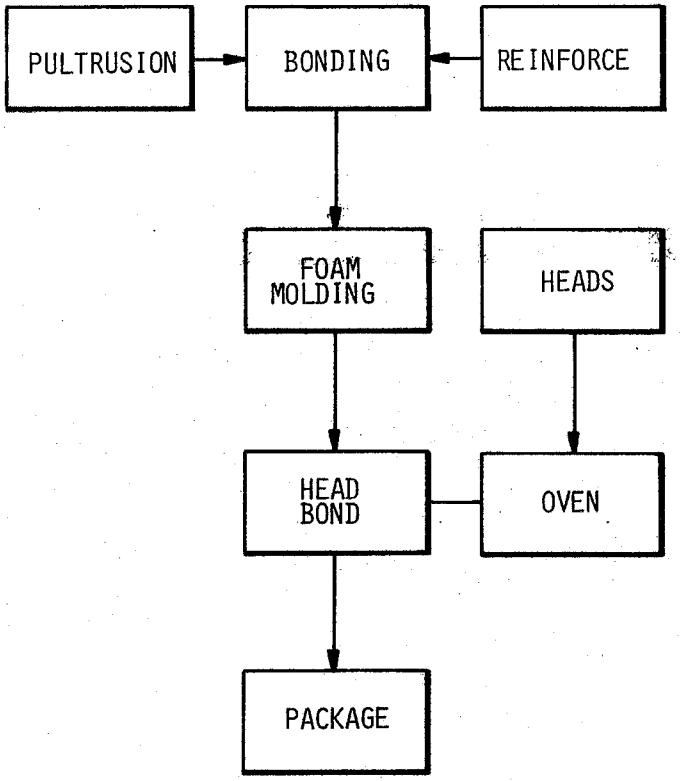
FIG. 10 is a flow diagram illustrating various steps of the method by which the impact tool is made.
Figure 9:
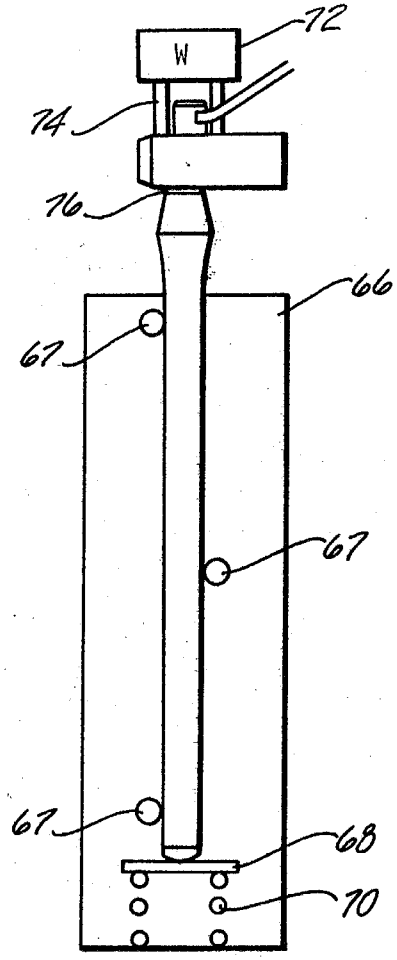
FIG. 9 is a view of a fixture used during another step of the method.
Figure 8:
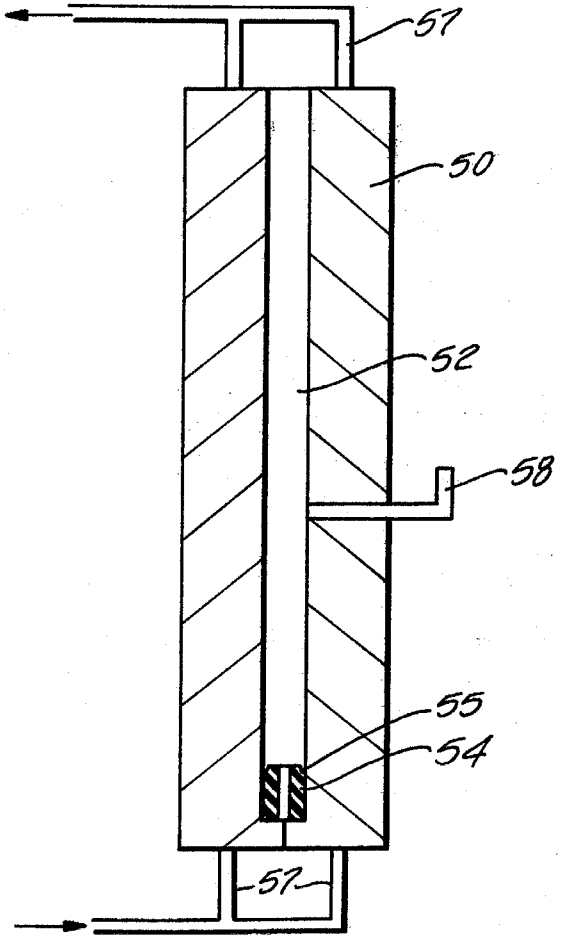
FIG. 8 is a diagrammatic, cross sectional view of a mold used during one of the steps by which the impact tool is made.

The method by which the impact tool 10 is manufactured is shown in flow diagram form in FIG. 10 and begins with making the core member 30 forming the principal structural member of the handle 14 and including the mounting stem 20. In general, this includes immersion of continuous filaments of glass fiber in bath of liquid resin and by pulling a large number of such resin coated fibers through a heated die which forms and partially cures the core material in a continuous length. The pultrusion is subsequently sawed to the desirable overall length. The content of glass fiber in the matrix of cured resin is to the order of 60 to 70 percent. The resin matrix can be formed solely of resin or if desired, can include a filler.

After a quantity of core members 30 are formed to length, one end of each handle 14 is fitted with the pair of reinforcing members 32. The reinforcing members are made of metal or plastic and preferably are not bonded in the cavity formed on the opposite sides of the web 34 to extend for the full length of the stem 20 and into the shank portion 24 for a distance of several inches from the head 12. Also, the end cap 42 is attached by placing it on the end of the core 30 opposite the stem 20.

After the core member 30 is provided with the reinforcing members 32 and end cap 42, the assembly is ready for foam molding. The foam molding occurs in a two part mold made of aluminum and having a cavity 52 extending vertically. The walls of the cavity can be formed so that the finished product has a wood grain or other decorative, textured appearance. The bottom of the mold is provided with a pair of mating seals 54 and adapted to receive the stem 20. The seals 54 serve to center the stem end of the core member 30 in the cavity 52 and has an annular recess 55 which acts with the walls of the mold to form a cavity for forming a seal. In addition, the elements 54 form a seal which closes the bottom of the cavity 52.

The upper end of the mold cavity 52 is closed by the end cap 42 at the end of core member 30 which also acts to center the butt end of core member 30 axially within the cavity 52. The end cap is provided with a pair of vent holes 56 one of which can be seen in FIG. 2 and which permit the escape of gases during the foaming reaction.

The mold 50 is provided with a manifold of passages 57 by which water can be circulated to heat the mold 50 to maintain the temperature between 130 and 140 degrees Fahrenheit. With a core member 30 disposed within the cavity 52 the mold 50 is in condition to receive a predetermined volume of liquid foaming resin which expands during the foaming reaction and expels excess gases through the vent holes 56 in the end cap 42.

A predetermined volume of liquid foaming resin including desired pigment is introduced into the cavity 52 of the mold 50 through a gate 58 located immediately above the level that is established by the volume of injected liquid resin before it begins to polymerize and foam. This prevents liquid resin from leaking back through the gate 58 and after foaming begins, the gate 58 is closed by foam which continues to expand and to occupy the entire cavity 52 with excess air and gases being ejected through the vents 56. As foaming approaches completion, some foam forms in the vents which together with the bonding characteristics of the foam assists in holding the end cap firmly in position on the handle 14.

The foaming reaction is exothermic and heat is transferred to the mold 50. As a consequence, the temperature of heating water in passages 57 must be varied to maintain the mold temperature between 130 and 140 degrees Fahrenheit. The heating of the molds accelerates reaction adjacent the bowl surfaces and is responsible for the formation of skin 38 which has a higher density than the remainder of the foam cover 36.

The foaming operation in the mold 50 is allowed to continue for a period of at least four and one-half minutes to permit preliminary curing of the foam cover 36 about the core member 30 so that the handle 14 can be handled for further processing. Subsequently, the handle 14 is removed from the mold 50 and the flash, if any, formed at the parting line between the mold halves is removed. Curing of the handle will continue for a period of twenty four hours or more but during that period of time, additional process steps may be carried on.

The partially polymerized handle 14 is subsequently placed in a fixture 66 so that the handle 14 is disposed vertically by pins 67 with the stem 20 at the top and with the end cap 42 resting on a plate 68 supported by a spring 70. The wire mesh element 40 is placed over the stem 30 and the sub assembly is now ready to receive the head 12.

Figure 7:
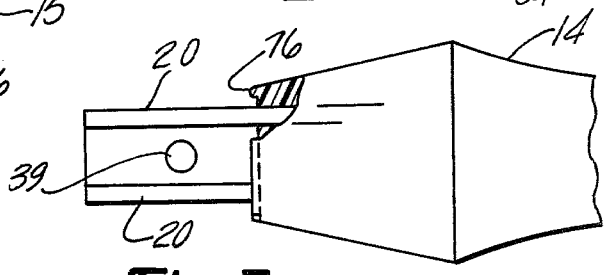
FIG. 7 is a view of a portion of the handle with the head removed.

Prior to positioning the head 12 on the stem 20, the heads are heated in a furnace to a uniform temperature in the range of 130 to 135 degrees Fahrenheit if the ambient temperature is approximately 70 degrees Fahrenheit, and to a corresponding higher range if the ambient temperature is lower. After the heads 12 are heated, they are placed in position on the stem 20 over the wire mesh sheath 40 and a weight 72 is applied to a fixture 74 so that a force of approximately 80 pounds is applied downwardly on the handle 14 and against the force of the spring 70. The weight 72 serves to press the head 12 tightly into engagement with an annular seal portion 76 formed by the foam material adjacent to the stem 20 as seen in FIG. 7. Because the heads 12 have a fairly wide range of dimensional tolerance, it is necessary to press the head 12 into engagement with the seal 76 so that the seal is slightly deformed. This insures that the bottom of the socket 17 is sealed against leakage of resin which is subsequently placed in the socket.

With the mesh element 40 in position on the stem 20 of the handle 14 and with the temperature of the head being in the range of 130 to 135 degrees, a urethane adhesive of a predetermined quantity is delivered to the socket 17. The resin is thereafter allowed to cure for several minutes after which the weight 72 is removed and the partially cured impact tool 10 can be removed from the fixture 74 for movement to storage or other processing stations such as packaging.

While the final curing is occurring, the sleeve member 48 of elastomeric material is placed on the handle 14 and particularly in the area of the shank 24 adjacent to the head 12 to further protect that area of the tool 10 from overstrikes or shock loads which occur when the head 12 does not hit the object of the impact.

A swingable impact tool has been provided in which a metal head is fastened to a handle made up of a structural core member giving stiffness and torsional rigidity to the handle and made up of polymerized thermosetting resin binder reinforced with a high density of fiberglass filaments and covered with a cover of microcellular elastomeric foam so that the cover protects the core member from shock loads and absorbs the transfer of impact loads to the hands of the user. The handle has a thicker covering of foam adjacent the head member where overstrikes may occur when the object of the impact blow is missed and which also is reinforced with metal members to give additional strength. The metallic head is secured to the handle by means of a polymerized resin which forms a chemical bond with the metallic head and with the handle. Mechanical connections also are formed to firmly secure the head to the handle.

The embodiments of the invention in which an exclusive property or privilege is claimed are defined as follows:

1. A swinging impact tool comprising: a metallic head member forming a handle receiving socket, a handle including the stem portion at one end, said stem portion being supported in the socket of said head member, said handle including a core member extending longitudinally the full length of said handle, said core member having a substantially uniform I-shaped cross section having a web extending in the plane of swinging movement of said tool and being formed of a polymerized thermosetting resinuous binder reinforced with fiberglass filaments, a resilient molded cover extending from said head and enveloping said core member, said cover being disposed symmetrically relative to said core member, said socket of said head member containing said stem portion to form a space between the walls of said socket and said stem, a pair of reinforcing members bonded to opposite sides of said web to extend within said socket member in an area adjacent said head for reinforcing said handle, and a polymerized resin filling the space between said head member and stem to bond said handle in fixed relationship to said head member.

2. The swinging impact tool of claim 1 wherein said handle has a generally ellipsoidal cross section with the major axes of the cross sections extending generally in the plane of swinging movement of said tool, the major axes of the cross sections being longer adjacent said head than at the remainder of said handle to protect said core member from impact adjacent said head.

3. The swinging impact tool of claim 1 wherein said handle has a generally ellipsoidal cross section with the minor axes of the cross sections extending transversely to the place of swinging movement of the handle and being shorter adjacent said head then at the remainder of said handle.

4. The swinging impact tool of claim 1 wherein a reinforcing element is bonded to a portion of said core member disposed in said socket and exterior of said socket adjacent to said head.

5. The swinging impact tool of claim 1 and further comprising a flexible, tubular sleeve disposed on said handle adjacent to said head.

6. The swinging impact tool of claim 1 wherein said core member has a content of fiberglass filaments of 60 to 70 percent of the cross sectional area of said core member.

7. The swinging impact tool of claim 1 wherein said stem portion has an opening extending transversely thereof and wherein said polymerized resin occupies said opening to provide a mechanical connection between said stem and polymerized resin.

8. The swinging impact tool according to claim 1 and further comprising an end cap in engagement with said core member and said cover to shield the end of said handle.

9. The swinging impact tool of claim 1 wherein said molded cover has an outer skin portion of greater density than the remainder of said cover.

10. A swinging impact tool comprising: a metallic head member forming a handle receiving socket, a handle including the stem portion at one end, said stem portion being supported in the socket of said head member, said handle including a core member extending longitudinally the full length of said handle, said core member having a substantially uniform cross section and being formed of a polymerized thermosetting resinuous binder reinforced with fiberglass filaments, a resilient molded cover extending from said head and enveloping said core member, said cover being disposed symmetrically relative to said core member, said socket of said head member containing said stem portion to form a space between the walls of said socket and said stem, and a polymerized resin filling the space between said head member and stem to bond said handle in fixed relationship to said head member and a wire mesh element surrounding said stem and said mesh element is disposed in said polymerized resin to reinforce the stem and mechanically link portions of the resin at opposite ends of the socket in said head.

* * * * *